US006364136B1

(12) United States Patent
Weshler et al.

(10) Patent No.: US 6,364,136 B1
(45) Date of Patent: Apr. 2, 2002

(54) SLIDING HEIGHT-ADJUSTABLE TRAY SHELF UNIT

(75) Inventors: Benjamin S. Weshler, Old Westbury; Stephen Moore, New York; Jeffrey Fox, Bellrose, all of NY (US)

(73) Assignee: Display Systems, Inc., Maspeth, NY (US)

( * ) Notice: Subject to any disclaimer, the term of this patent is extended or adjusted under 35 U.S.C. 154(b) by 0 days.

(21) Appl. No.: 09/769,624

(22) Filed: Jan. 25, 2001

Related U.S. Application Data

(60) Provisional application No. 60/233,588, filed on Sep. 18, 2000.

(51) Int. Cl.[7] ..... A47F 5/00

(52) U.S. Cl. ..... 211/90.02; 211/175; 211/126.15; 108/143; 108/102; 312/408

(58) Field of Search ..... 211/90.02, 151, 211/175, 126.15; 312/334.14, 408; 108/143, 102, 105

(56) References Cited

U.S. PATENT DOCUMENTS

| | | | | | |
|---|---|---|---|---|---|
| 1,315,922 | A | | 9/1919 | Franklin | |
| 3,311,072 | A | | 3/1967 | Pattison | |
| 4,620,489 | A | | 11/1986 | Albano | |
| 4,646,658 | A | | 3/1987 | Lee | |
| 4,938,442 | A | * | 7/1990 | Mastrodicasa | |
| 5,297,486 | A | * | 3/1994 | Herrmann et al. | 108/108 |
| 5,340,209 | A | | 8/1994 | Kolbe et al. | |
| 5,486,046 | A | * | 1/1996 | Jernstrom et al. | 312/408 |
| 5,531,159 | A | * | 7/1996 | Stubblefield | 108/102 |
| 5,720,230 | A | | 2/1998 | Mansfield | |
| 5,735,589 | A | | 4/1998 | Herrmann et al. | |
| 5,813,741 | A | | 9/1998 | Fish et al. | |
| 5,855,283 | A | | 1/1999 | Johnson | |
| 5,970,887 | A | | 10/1999 | Hardy | |
| 6,227,636 | B1 | * | 5/2001 | Lye et al. | 312/408 |

* cited by examiner

*Primary Examiner*—Robert W. Gibson, Jr.
(74) *Attorney, Agent, or Firm*—Davidson, Davidson & Kappel, LLC

(57) ABSTRACT

A sliding and height-adjustable tray shelf unit of a display apparatus has a shelf that slides inward and outward relative to the display apparatus is also adjustable vertically relative to the slotted standard of the display apparatus. Each sliding shelf can also incorporate a removable modular tray in order to allow one tray to be replaced with another tray, perhaps already pre-stocked with items to be displayed. Each sliding shelf also has a support frame that is mounted to the display apparatus or standard by way of hooked prongs or flanges that interact with the slots within the standard. A tray support base or a display tray is mounted to the support frame by any of several ways such that the tray support base "slides" relative to the support frame, such as by wheels that rotate within tracks, pegs or detent tabs that slide forward and backward within tracks cut into a flat surface, and a molded section that slides along an upstanding edge or rail. A display tray can optionally be removably placed into the tray support base for display of merchandise, and the display tray could be pre-stocked with merchandise.

17 Claims, 3 Drawing Sheets

17
10
52
53
16
14
12
18
2
51
18
13
15
A
B
19
11
4
A
B
19
12
14
5
13
3
4

15
25
21
29
24
22
15
A
B
14
54
29
24
31
AB
22
25
23

SLIDING HEIGHT-ADJUSTABLE TRAY SHELF UNIT

This application claims benefit to provisional No. 60/233,588, filed Sep. 18, 2000.

BACKGROUND OF THE INVENTION

This invention relates to the field of support systems for use in display devices and other elements. More particularly, this invention relates to support shelving, and to sliding and height-adjustable display shelves and modular trays.

In the field of retail sales, items for sale or other merchandise is generally displayed on a display or support system. Many different forms of custom-built support systems are known, and these generally include partition walling and upright support posts. The support posts of such retail merchandise display units, often called "standards", are generally formed of roll formed steel sections mounted into weighted bases and have vertically-oriented slots of varied height, width, depth and spacing cut into the front of the standards along the height of the standard, from top to bottom. Other elements, such as horizontal pole brackets or bars (called "faceouts"), shelves or the like, can be adjustably secured to the standards by interaction between the slots and the slot-specific hooked prongs or flanges that are formed on the attachment portion of the faceouts, shelves or other attachments. The faceout bars and other attachments are thus vertically adjustable relative to the upright in order to allow the retailer to raise or lower these attachments, and the items displayed thereon, as desired.

Typically, however, once a display unit is constructed, stocking it with merchandise can be a difficult chore, especially where the shelves are deep, where the shelves are placed in close vertical relation with one another and where the items to be stocked are delicate or small. In addition, if the stock of merchandise is not generally located near the display unit, it is often desired to prepare the display of merchandise near the merchandise stock and then place the display on the shelves.

Accordingly, it is desirable to provide a display device having shelves that are vertically adjustable on standard upright units and that are movable inward and outward relative to the display unit.

It is also desirable to provide a display device having modular trays into which display arrangements can be placed and replaced.

SUMMARY OF THE INVENTION

Accordingly, it is one object of this invention to provide an improved display apparatus having shelves that slide inward and outward and are also adjustable vertically with respect to the display apparatus base.

It is another object of this invention to provide an improved display apparatus that would allow an entire display within a sliding shelf to be changed easily and quickly.

It is a further object of this invention to provide an improved display apparatus having modular trays that can be replaced without disassembly of the display unit.

These and other objects and advantages of the invention are accomplished in accordance with the principles of the invention by providing a sliding and height-adjustable tray shelf unit of a display apparatus, in which a shelf that slides inward and outward relative to the display apparatus is also adjustable vertically relative to the slotted standard of the display apparatus. Each sliding shelf can also incorporate a removable modular tray in order to allow one tray to be replaced with another tray, perhaps already pre-stocked with items to be displayed. Each sliding shelf comprises a support frame that is mounted to the display apparatus or standard by way of hooked prongs or flanges that interact with the slots within the standard. A tray support base or a display tray is mounted to the support frame by any of several ways such that the tray support base "slides" relative to the support frame, such as by wheels that rotate within tracks, pegs or detent tabs that slide forward and backward within tracks cut into a flat surface, and a molded section that slides along an upstanding edge or rail. A display tray can optionally be removably placed into the tray support base for display of merchandise, and the display tray could be pre-stocked with merchandise.

BRIEF DESCRIPTION OF THE DRAWINGS

The above and other objects and advantages of the invention will be apparent upon consideration of the following detailed description, taken in conjunction with the accompanying drawings in which the reference characters refer to like parts throughout and in which.

DETAILED DESCRIPTION OF THE INVENTION

Figure 1:
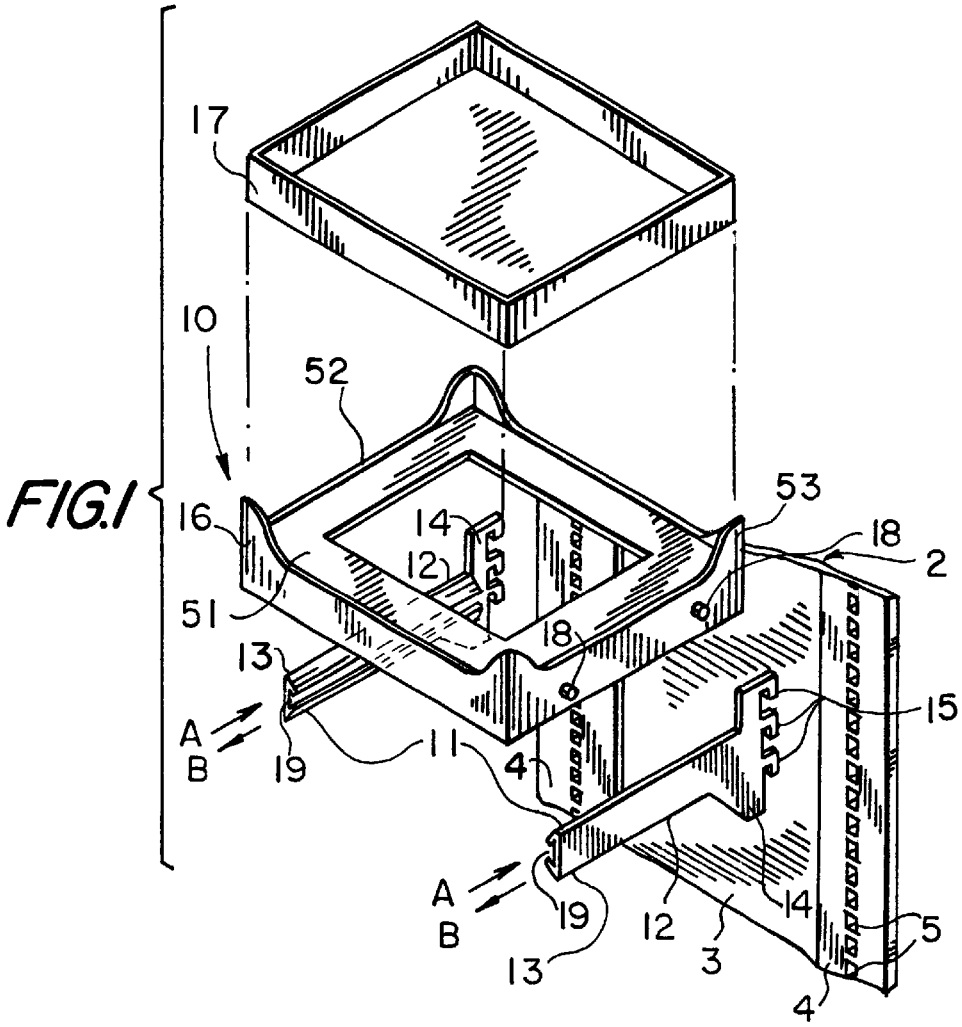
FIG. 1 shows an exploded perspective view of a first embodiment of the invention.

Referring now to the drawings, in particular to FIG. 1, the sliding height-adjustable tray shelf unit 10 of the current invention is shown in exploded perspective view positioned for attachment to a section of a display unit mounting wall 2, which in FIG. 1 has a section of wall 3 bounded on two sides by two upright standards 4 through which a specific desired pattern of slots 5 has been pre-formed. The section of wall 3 may also have a pattern of holes formed therethrough, such as in a standard a peg board or the like, for suspending the display unit sections or suspending custom slotted standards 4 that may be different from the slotted standard already possessed by the retailer or by the location where the display apparatus is to be employed.

In accordance with the present invention, as shown in FIG. 1, sliding height-adjustable tray shelf unit 10 has several elements or pieces that are fitted together, including a support frame 11, a tray support base 16 and a modular tray 17. Support frame 11 is attached directly to display unit mounting wall 2, thereby typically providing the stability for sliding modular tray shelf unit 10. Support frame 11 could be one unitary piece, as shown in the embodiments of support frame 21 in FIGS. 2 and 6, or could be in more than one piece, such as by having two or more arms 12, as shown in FIG. 1. Support frame 11 could be formed in any of many known ways and with any of many known materials, but is preferably formed of a molded plastic or a metal, such as roll formed steel or aluminum, for strength and relative inexpensiveness.

Figure 2:
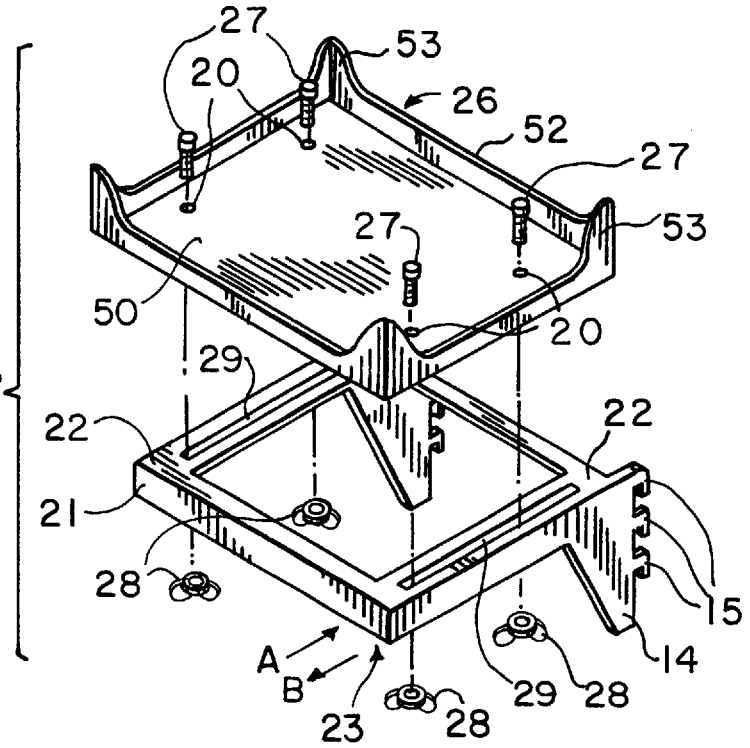
FIG. 2 shows an exploded perspective view of the support frame and the tray support base of a second embodiment of the invention.

Support frame 11 (whether in one or more pieces) has a rear, wall attachment portion 14 and a forward, supporting portion 13. Attachment portion 14 should be built sturdily and could comprise any device or construction for easily attaching support frame 11 to a display unit wall 2 or standard 4. Attachment portion 14 should preferably allow support frame 11 to be readily detached from display unit wall 2 in order to allow its position relative to display unit wall 2 or standard 4 to be changed at will. This construction consists preferably of at least one hooked prong or flange 15, as shown in FIGS. 1 and 2. Hooked prongs or flanges 15, which are generally standard in the field, are typically integrally formed with attachment portion 14 of support frame 11 at their proximal, attached ends and are bent downward at their distal, free ends.

In order to allow support frame 11 to easily and firmly attach to slotted standard 4, hooked flanges 15 should also match slots 5 in standard 4 in both depth and spacing. Accordingly, if standard 4 is equipped with custom designed slots 5 whose widths, depths or spacing is not standard, hooked flanges 15 should match slots 5 in the relevant dimensions in order to allow a proper and snug fit and proper support for tray unit 10. Thus, support frame 11 is attached to a standard 4 by inserting hooked flanges 15 into respective slots 5 within standard 4 and pressing support frame 11 downward to set hooked flanges 15 within slots 5. Thus, free ends of hooked flanges 15 abut and grip back side (not shown) of standard 4 or display unit wall 2.

Although each side of the rear-facing end of attachment portion 14 of support frame 11 is shown with three hooked prongs or flanges 15, attachment portion 14 of support frame 11 could just as easily have fewer or more than three hooked prongs or flanges 15, so long as support frame 11 and the load borne thereby is sufficiently and stably supported. For attachment to slotted standard 4, as shown in FIG. 1, the set of three hooked flanges 15 shown will fit into a set of three respective slots 5. This is, of course, true as well with respect to the different embodiments of support frames 21,31,41 shown in FIGS. 2, 6 and 7.

When it is desired for the vertical position of support frame 11 and its attachments to be changed, support frame 11 is lifted slightly, in order to allow the free ends of hooked flanges 15 to be free of standard 4 or display unit wall 2, and support frame 11 is pulled away from display unit wall 2 or standard 4 (in the direction of arrow B). The "height," i.e., the vertical position, of support frame 11 can then be adjusted by resetting hooked flanges 15 into another set of slots 5.

In the present invention, tray support base 16 is mounted to support frame 11 such that it moves horizontally relative to support frame 11. In addition, tray support base 16 is also designed to support optional interchangeable modular display trays 17 that may be used for display of saleable items. Tray support base 16 and each of interchangeable modular display trays 17 that are used for display of saleable items could be formed in any of many known ways but are preferably formed of a molded plastic or metal. A modular display tray 17 is placed into tray support frame 16 when merchandise is desired for display, and this display tray 17 could be pre-stocked with merchandise. Each modular tray 17 is sized to fit snugly within tray support base 16, yet may be removed therefrom with ease so that it can be replaced with another modular tray 17 by the retailer or salespeople without difficulty whenever it is desired for displays to be changed. Thus, restocking of merchandise need not be done at the display unit but instead can be done on a modular tray 17 away from the site, carried to the site already on a modular tray 17, and inserted into the modular tray area of tray support base 16.

Figure 3:
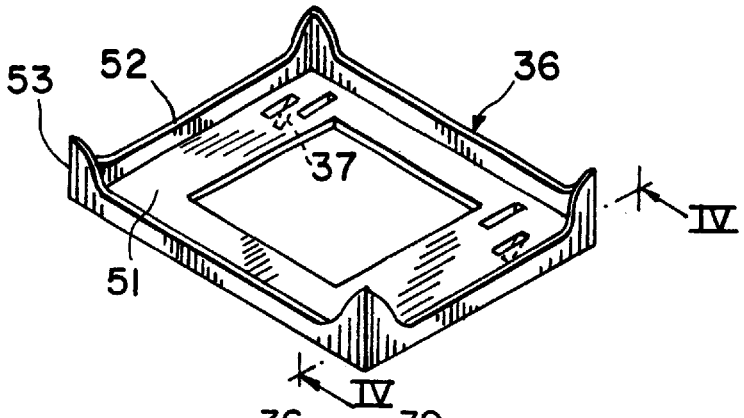
FIG. 3 shows a perspective view of the tray support base of a third embodiment of the invention.

Tray support base 16 should also be sized and shaped to match the size and shape of interchangeable trays 17. In the embodiments of FIGS. 1–3, both interchangeable tray 17 and tray support bases 16,26 are rectangularly shaped. Tray support base 16,26 should have support at its bottom in order to retain tray 17 and prevent tray 17 from falling through tray support base 16,26, and this bottom support could preferably in the form of a complete bottom surface 50, as shown in FIG. 2, but alternatively could be in the form of partial bottom surfaces or returns 51, as shown in FIGS. 1 and 3. In addition, tray support base 16,26 should have support at its sides to retain tray 17 and to prevent it from slipping sideways off tray support base 16,26, and this side support could be in the form of walls or at least partial walls or returns 52 and corner pieces 53 that retain tray 17 at its corners, in the case of trays 17 and tray support bases with comers, or both, as shown in FIGS. 1–3.

Tray support base 16 is mounted to support frame 11 and is designed to move relative to support frame 11 in a direction perpendicular to display unit wall 2. Tray support base 16 could be mounted by any of several ways. In one embodiment, as shown in FIG. 1, tray support base 16 is equipped with rollers or wheels 18, and these wheels 18 rotate within tracks 19 that are formed at the forward, supporting portion 13 of support frame 11. In order to affix tray support base wheels 18 within tracks 19, wheels 18 are first situated adjacent to the far, distal ends of forward portions 13 of support frame tracks 19 and are then inserted into tracks 19 in the direction of arrow A. Thus, wheels 18 of tray support base 11, by rolling freely within tracks 19, allow tray support base 11 to "slide" in and out, in the directions of arrows A and B, respectively, relative to display unit wall 2 or standard 4. A standard stopping mechanism (not shown) prevents wheels 18, once inserted into tracks 19, from being easily pulled out of tracks 19, in order to lend stability to the sliding mechanism.

Figure 6:
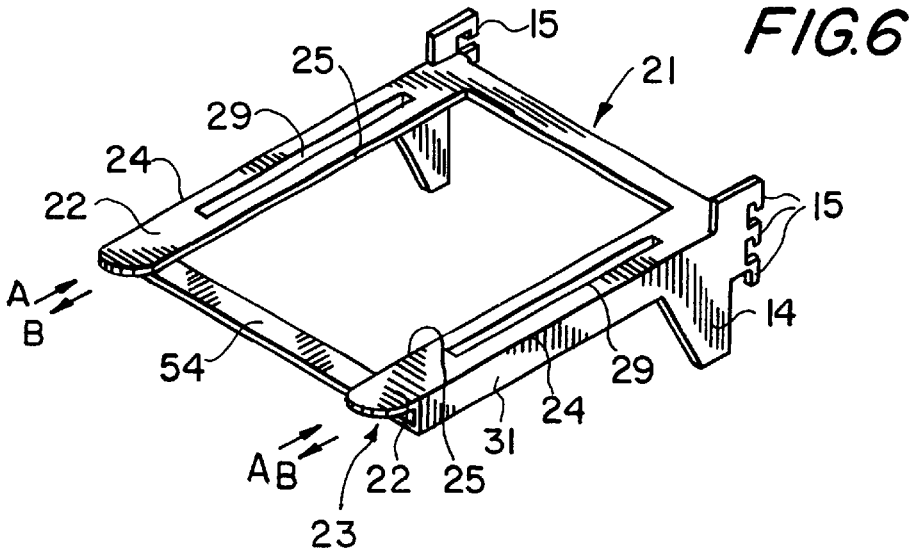
FIG. 6 shows a perspective view of the support frame of a third embodiment of the invention.

FIGS. 2 and 6 show an alternative embodiment of the mechanism that allows tray support base 26 to be mounted to support frame 21 and to move relative thereto. Support frame 21, whether in one piece or more, has at least two flat upper surfaces 22 that extend in a forward direction, at least one on either side of support frame 21, and an elongated track 29 is formed in or is cut through each of these flat upper surfaces 22. In addition, tray support base 26 has at least one aperture 20, preferably two, that is formed through its bottom surface 50 at a position in bottom surface 50 exactly above each track 29. Each of these apertures 20 is designed to accommodate a screw or a peg 27 that is threaded through the respective aperture 20 and into the respective track 29. Nuts 28, shown in FIG. 2 as butterfly nuts, secure screws 27 on the bottom side of tracks 29 so that screws 27 do not loosen and come out of apertures 20, thereby dislodging tray support base 26 from support frame 21.

Once screws 27 are set through apertures 20 and within tracks 29, tray support base 26 can move back and forth, i.e., slide in and out, in the directions of arrows A and B, respectively, relative to display unit wall 2 or standard 4, by virtue of the back and forth movement of screws 27 within tracks 29 in support frame 26. A washer or the like may be situated between nut 28 and the underside of support frame 21 in order to allow nuts 28 to slide smoothly, along with tray support base 26 and screws 27, along the underside of support frame 21. Tracks 29 are formed into support frame 21 preferably in a direction parallel to each other and preferably in a direction perpendicular to the plane of wall 2 or of the front of standard 4. Thus, tray support base 26 moves smoothly and without hitch when pulled in the direction of arrow A in FIGS. 1, 2 and 6.

The forward ends of tracks 29 provide a stop mechanism to prevent tray support base 26 from being pulled off forward end 23 of support frame 21 when tray support base 26 is pulled completely away from display unit wall 2. When tray support base 26 is pulled away from wall 2 or standard 4 in the direction of arrow B, front-most screws 27 will contact the front edges of tracks 29, thereby preventing tray support base 26 from being pulled further in the direction of arrow B and off support frame 21. In addition, the forward end of tracks 29 should not be too close to forward end 23 of support frame 21; otherwise, the moment (torque) caused by the combined weight of tray support base 26, tray 17 and the contents of tray 17 about this point (forward end 23 of support frame 21) may cause screws 27 to be loosened or even dislodged from tracks 29 or cause support frame hooked flanges 15 to be dislodged from their slots 5, thereby toppling tray support base 26 over forward end 23 of support frame 21.

Figure 4:
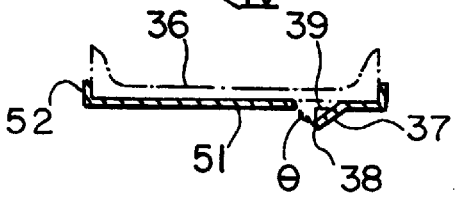
FIG. 4 shows a cross-sectional view of the tray support base of FIG. 3 taken along line IV—IV of FIG. 3.
Figure 5:
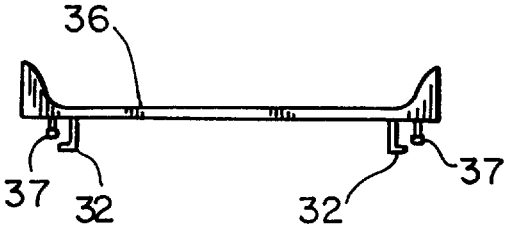
FIG. 5 front elevational view of the tray support base of FIG. 3.

FIGS. 3–5 show another embodiment of the mechanism that allows tray support base 36 to be mounted to support frame 21 and to move relative thereto. In this embodiment, tray support base 36 has at least one detent tab 37 that protrudes in a downward angled direction relative to bottom surface 51 of tray support base 36. In a preferred embodiment, detent tabs 37 are molded from (i.e., as part of, but cut out from) bottom surface 51 of tray support base 36 and are angled in a downward direction relative to bottom surface 51. As such, each detent tab 37 has an inherent spring loading due to its integral formation as part of the same material and structure, and because of the resistance or stiffness of the material of that structure, from which bottom surface 51 of tray support base 36 and detent tabs 37 are made. This embodiment of the sliding mechanism of tray support base 36 is to be used preferably with the embodiments of support frame 21 described above and shown in FIGS. 2 and 6, wherein support frame 21, whether in one piece or more, has at least two flat upper surfaces 22 that extend in a forward direction, at least one on either side of support frame 21, and a track 29 is formed in or is cut through each of these flat upper surfaces 22.

Each of detent tabs 37 of the embodiment of the sliding mechanism shown in FIGS. 3–5 is formed through bottom surface 51 of tray support base 36 at a position in bottom surface 51 corresponding exactly to the location of a track 29 in support frame 21. Once detent tabs 37 are placed within tracks 29, tray support base 36 can move back and forth, i.e., slide in and out, in the directions of arrows A and B, respectively, relative to display unit wall 2 or standard 4, by virtue of the gliding back and forth movement of detent tabs 37 within tracks 29 in support frame 21. Thus, when tray support base 36 is pulled out in the direction of arrow B in FIG. 1, tray support base 36 moves smoothly and without hitch.

The downward angle of detent θ of detent tabs 37 could be any acute angle and is preferably less than approximately 45° from horizontal, and most preferably is approximately 15° from horizontal. Angle of detent θ could also depend upon the material from which support frame 21 and tray support base 36 are formed and upon the thickness of that material. In one embodiment, angle of detent θ would not be so large as to leave a gap between the upper surface of leading end 38 of detent tab 37 and the underside of bottom surface 51 of tray support base 36 that is larger than the thickness of support frame 21. If such a gap is formed, when tray support base 36 is pulled to its farthest position toward forward end 23 of support frame 21, leading ends 38 of detent tabs 37 may slip under the underside of support frame 21 rather than merely contacting the front edges of tracks 29, thereby trapping tray support base 36 onto support frame 21 and preventing its movement relative thereto. Thus, in this embodiment, when tray support base 36 is pulled away from wall 2 or standard 4, the front surface of leading ends 38 of detent tabs 37 will contact the front edges of tracks 29, thereby preventing tray support base 36 from being pulled off forward end 23 of support frame 21 in the direction of arrow B.

In another embodiment, each detent tab 37 is formed with one or more ribs 39 along its upper surface. These ribs 39, shown best from a side view as illustrated in FIG. 4, preferably extend highest at the leading ends 38 of detent tabs 37 and thereby form a barrier or an abutting surface for preventing detent tabs 37 from slipping under the underside of support frame 21 when tray support base 36 is pulled all the way away from wall 2 or standard 4 and detent tabs 37 contact the front edges of tracks 29. These ribs 39 could be as wide as detent tabs 37 themselves but more preferably are narrow, and are prepared as an additional section integrally formed as part of detent tabs 37 at the time of molding. In a preferred embodiment, the upper surfaces of detent tab ribs 39 are at a level no lower than the underside of bottom surface 51 of support frame 36, such that no gap exists between the upper surfaces of detent tab ribs 39 and the underside of bottom surface 51 of tray support base 36, in order that neither detent tabs 37 nor ribs 39 can slip under the underside of support frame 21. Further, in a preferred embodiment, the upper surfaces of detent tab ribs 39 are at approximately a level no higher than upper side of bottom surface 51 of tray support base 36, such that there is no interference with the bottom surface of any modular trays 17 that are placed within tray support base 36.

When tray support base 36 is pulled away from wall 2 or standard 4 in the direction of arrow B towards forward end 23 of support frame 21, the front surface of the leading end of detent tabs 37 will contact the front edges of tracks 29, thereby preventing tray support base 36 from being pulled off forward end 23 of support frame 21 in the direction of arrow B. But, if the front edges of tracks 29 are too close to forward end 23 of support frame 21, the moment (torque) caused by the combined weight of tray support base 36, tray 17 and the contents of tray 17 about this point (forward end 23 of support frame 21) may cause detent tabs 37 to be lifted out of tracks 29 or cause support frame hooked flanges 15 to be dislodged from their slots 5, thereby toppling tray support base 36 over forward end 23 of support frame 21. The embodiment of tray support base 36 shown in FIG. 3, when used with the embodiment of support frame 21 shown in FIG. 6, provides a mechanism to prevent tray support base 36 from toppling off forward end 23 of support frame 21 in this manner.

In order to avoid this type of accident, a preferred embodiment of tray support base 36 is provided with L-shaped gripper elements 32 adjacent to detent tabs 37, as shown in FIGS. 3 and 5. These gripper elements 32 are formed through bottom surface 51 of tray support base 36 at a position in bottom surface 51 alongside and interior to detent tabs 37. Each gripper element 32, as shown in a cross-sectional view in FIG. 5, protrudes first in a downward direction relative to bottom surface 51 of tray support base 36 and, at the end of the downward portion, projects outward, toward the nearest detent tab 37, thereby forming an L-shape. In a preferred embodiment, gripper elements 32 are molded from (i.e., as part of, but cut out from) bottom surface 51 of tray support base 36, as shown best in FIG. 3, and are most preferably longer than detent tabs 37. As such, each gripper element 32 has an inherent resistance or stiffness due to its integral formation as part of the same material and structure from which bottom surface 51 of tray support base 36 and detent tabs 37 are made.

This embodiment of tray support base 36 having gripper elements 32 is to be used preferably with the embodiment of support frame 21 shown in FIG. 6, wherein support frame 21 has two arms 24 that extend in a forward direction, each having at least one flat upper surface 22 on either side of support frame 21 into which a track 29 is formed or cut, and each having an inside edge 25, about which a respective gripper element 32 fits and is movable relative to. Support frame arms 24 may also have a transverse strut or crossbar 54 for stiffening and support of support frame arms 24. Preferably, transverse strut or crossbar 54 is somewhat below the level of support arms 24 and, in particular, inside edges 25 so as not to interfere with the interaction between gripper elements 32 with inside edges 25 of support arms 24. Transverse strut or crossbar 54 can be formed or molded as part of support frame 21, as shown in FIG. 6, or could be a separate piece that is attached afterwards, as shown in FIG. 7.

In order to affix tray support base 36 shown in FIG. 3 onto support frame 21 shown in FIG. 6, tray support base 36 is first situated at forward end 23 of support frame 21 such that the respective gripper elements 32 are situated adjacent to (but inside) the far, distal ends of forward portions 23 of support frame arms 24. Then, tray support base 36 is moved towards display unit wall 2 or standard 4, i.e., in the direction of arrow A, such that gripper elements 32 slide along inside edges 25 of support frame arms 24, and support frame arms 24 are situated to slide within the L-shaped structure of gripper elements 32. At a certain point, the lower surface of the back side of detent tabs 37 will contact forward edge 23 of support frame arms 24, and further movement of tray support base 21 in the direction of arrow A will cause detent tabs 37 to detent upward such that the lower surfaces of detent tabs 37 are at a level approximately no lower than lower surface 51 of tray support base 36, such that detent tabs 37 slide along flat upper surfaces 22 of support frame arms 24. Still further movement of tray support base 36 in the direction of arrow A relative to support frame 21 will then cause detent tabs 37, once they reach tracks 29 within support frame arms 24, to snap back to their downward position and rest within tracks 29. Then, detent tabs 37 may glide backwards and forwards within tracks 29 so that tray support base 36 may glide backwards and forwards relative to support frame 21, while gripper elements 32 provide a track, i.e., the inside of the L-shaped structure, for inside edges 25 of frame support arms 24.

Then, when tray support base 36 is pulled away from wall 2 or from standard 4 in the direction of arrow B, even though the front surface of leading ends 38 of detent tabs 37 will contact the front edges of tracks 29, thereby preventing tray support base 36 from being pulled off support frame 21 in the direction of arrow B, the moment (torque) caused by the combined weight of tray support base 36, tray 17 and the contents of tray 17 about this point (forward end 23 of support frame 21) will not cause tray support base 36 to topple over forward end 23 of support frame 21, because gripper elements 32 hold onto inside edges 25 of support frame arms 24 and prevent tray support base 36 from toppling off forward end 23 of support frame 21. In order to remove tray support base 36 from support frame 21, detent tabs 37 must first be pressed upwards, such that the lower surfaces of detent tabs 37 are approximately at a level no lower than lower surface 51 of tray support base 21, and clearance beyond top surface 22 of support frame 21 is created in order for detent tabs 37 to pass out of tracks 29. Then, tray support base 36 is pulled in the direction of arrow B such that detent tabs 37 slide along flat upper surfaces 22 of support frame arms 24. Still further movement of tray support base 36 in the direction of arrow B relative to support frame 21 will then cause detent tabs 37, once they reach forward edges 23 of support frame arms 24, to snap back to their downward position and be free of support frame 21.

Figure 7:
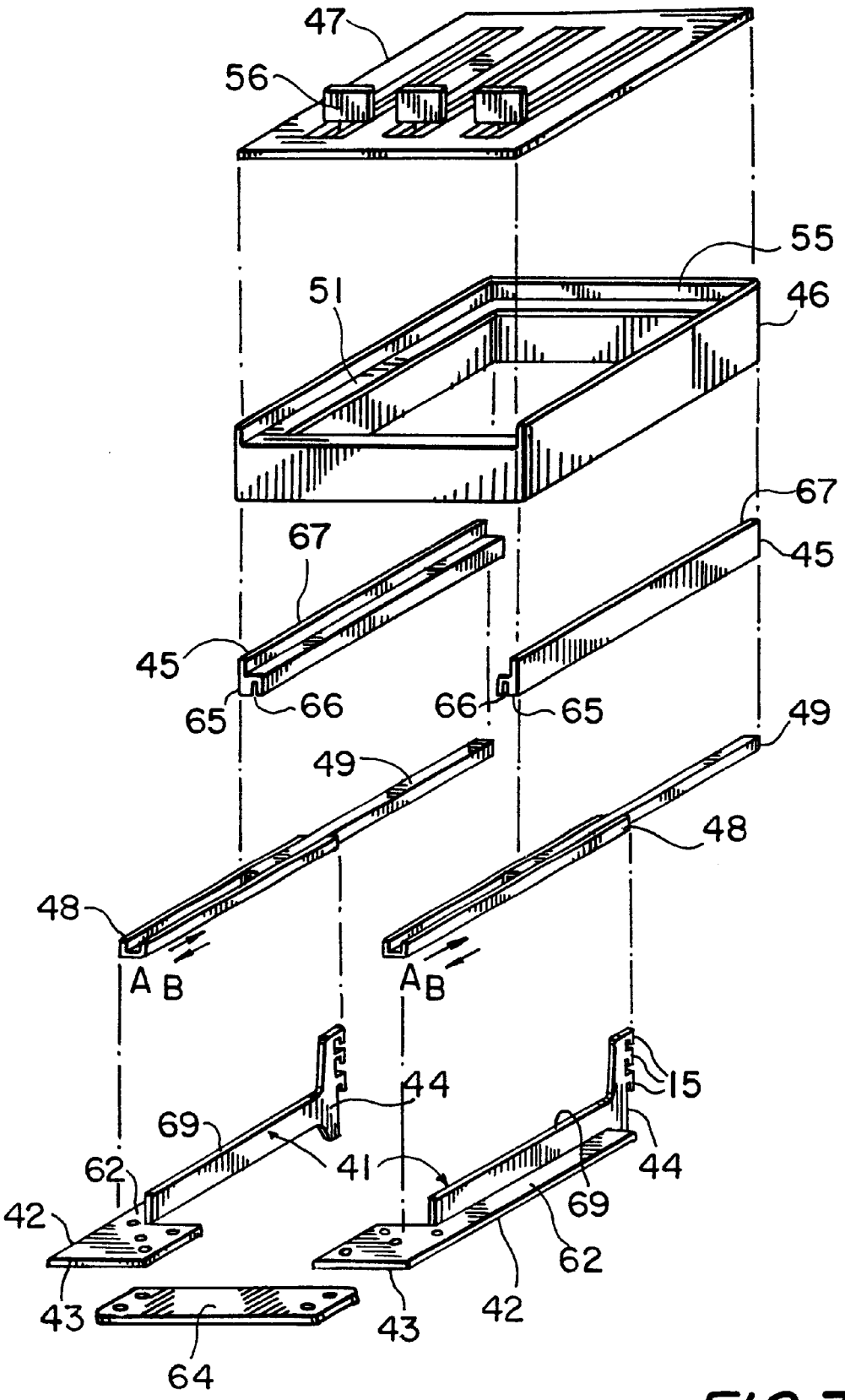
FIG. 7 shows an exploded perspective view of a fourth embodiment of the invention.

FIG. 7 shows an exploded perspective view of another embodiment of the sliding height-adjustable tray shelf unit of the present invention. This embodiment has several elements or pieces that are fitted together and that interact, including a support frame 41, gliding tracks 48,49, glide adaptors 45, a tray support base 46 and a tray 47. Support frame 41 has a rear, wall attachment portion 44 and a forward, supporting portion 43, and is attached directly to slots 5 in display unit mounting wall 2 using hooked flanges 15 on rear attachment portion 44 of support frame 41. Support frame 41 could be in more than one piece, such as by having two or more arms 42, or could be one unitary piece, as shown in the embodiments of support frame 21 in FIGS. 2 and 6. When support frame 41 is formed from more than one piece, such as shown in FIG. 7, support frame 41 may also have a transverse strut or crossbar 64 for stiffening and support of support frame arms 42. Transverse strut or crossbar 64 can be formed or molded as part of support frame 41 or could be a separate piece that is attached afterwards, as shown in FIG. 7, by any known means, such as welding, screws or rivets.

In this embodiment, tray support base 46 is mounted to support frame 41 such that it moves horizontally in the directions of arrows A,B relative to support frame 41. In addition, tray support base 46 is also designed to support optional interchangeable modular display trays 17, as shown in FIG. 1, that may be used for display of saleable items. A modular display tray 17 is placed into tray support base 46 when merchandise is desired for display, and this display tray 17 could be pre-stocked with merchandise. Alternatively, tray support base 46 may also be used to support interchangeable tray inserts 47 that may be dropped down into tray support base 46. Tray insert 47 is shown in FIG. 7 as being a flat plate with spring-loaded pusher plates 56 for urging products forward toward the front of tray insert 47, but of course tray inserts 47 may be in any other acceptable form. Each tray insert 47 is sized to fit snugly within tray support base 46, yet may be removed therefrom with ease so that it can be replaced with another tray insert 47 without difficulty. Thus, restocking of merchandise can be done on a modular tray 17 or a tray insert 47 away from the site and inserted into tray support base 46.

Tray support base 46 has support at its bottom to retain tray insert 47, and this bottom support could be in the form of a complete bottom surface 50, as shown in FIG. 2, or in the form of partial bottom surfaces or returns 51, as shown in FIG. 7. For support at the sides, tray support base 46 could have partial walls or returns 52 and corner pieces 53, as shown in FIGS. 1–3. In the case of tray inserts 47 without walls of its own, as shown in FIG. 7, tray support base 46 should preferably have complete walls 55. Tray insert 47 could also be secured onto bottom surface 51 such that tray inserts 47 are not generally removable.

FIG. 7 shows yet another embodiment of the mechanism that allows tray support base 46 to be mounted to support frame 41 and to move relative thereto. In this embodiment, each arm 42 of support frame 41, whether support frame 41 is in one piece or more, preferably has an elongated flat horizontal surface 62 and an elongated upstanding edge or rail 69, both of which extend in a forward direction along arm 42. As shown in FIG. 7, surface 62 and rail 69 are to allow tray support base 46 to move relative to support frame 41, as discussed below.

Gliding tracks are well known in the field and can be any of known tracks that slide or glide relative to each other. In one preferred embodiment, gliding tracks 48,49 have ball bearings between them to allow smooth relative movement. Preferably, gliding tracks 48,49 are formed from metal, plastic or some other durable material.

In a first embodiment shown in FIG. 7, the system of the invention also comprises a glide adaptor 45 on each side of tray support base 46. Glide adaptors 45 are elongated molded sections that provide an intermediate seat for securing upper glide track 49 to tray support base 46 and, at the same time, provide a mechanism for allowing tray support base 46 to slide along elongated upstanding edge or rail 69. Each glide adaptor 45 has a top portion 67 for attachment to the underside of tray support base 46. This attachment can be any of many known means, such as gluing, riveting, spot welding or friction fit. Each glide adaptor 45 also has a bottom portion 65 for attachment to upper glide track 49 and a bottom portion 66 for assisting movement between tray support base 46 and support frame 41. Bottom portion 65 is widened to allow proper attachment to upper glide track 49, and attachment between upper glide track 49 and glide adaptor 45 can be any of many known means, such as gluing, spot welding or friction fit. Bottom portion 66 possesses an elongated narrow recess to allow the elongated upstanding edge or rail 69 of arm 42 of support frame 41 to fit, whereby bottom portion 66 of glide adaptor sits atop upstanding edge or rail 69 and slides along edge or rail 69. Thus, when glide adaptor 45 is secured to tray support base 46, tray support base 46 slides along upstanding edges or rails 69 of arms 42 of support frame 41 and moves relative to support frame 41. Thus, tray support base 46 moves smoothly and without hitch when pulled in the direction of arrow B in FIG. 7. Preferably, transverse strut or crossbar 54 is somewhat below the level of rail 69 so as not to interfere with the interaction between glide adaptor 45 or glide tracks with support frame 41.

In the preferred embodiment, lower glide track 48 is attached to support frame 41, preferably on surface 62, and upper glide track 49 is attached directly to tray support base 46, preferably to the underside of tray support base 46, such that support frame 41 and tray support base 46 can move smoothly relative to each other by the sliding action between gliding tracks 48,49 and without the need for intervening parts. Gliding tracks 48,49 are attached to the top of the surface 62 and to the underside of tray support base 46 by any known means, such as by gluing, riveting, spot welding or friction fit.

Thus, a sliding and height-adjustable tray shelf unit of a display apparatus has been provided. One skilled in the art will appreciate that the present invention can be practiced by other than the described embodiments, which are presented for purposes of illustration and not limitation.

We claim:

1. An adjustable shelf assembly comprising:

a support unit having two longitudinal and generally horizontal support arms extending from a mounting end to a free end, said support arms being laterally spaced a distance apart and set generally parallel to each other, each of said support arms having a top surface, a bottom surface and an inside edge, said top surface having an elongated track formed therein and along the length thereof, said track having a front end near said free end of said support arm and a back end near said mounting end of said support arm;

a tray frame comprising an undersurface and having a width that is greater than the spacing between said support arms, said tray frame being movably mounted on said support arms for horizontal, longitudinal adjustment relative to said support unit;

two track guide members formed integrally with and extending downward from said tray frame undersurface, each of said track guide members being adapted to be set within a respective one of said elongated tracks and being adapted to move longitudinally with said tray frame within said track; and two L-shaped grip elements formed integrally with and extending downward from said tray frame undersurface for assisting in movement of said tray frame relative to said support unit.

2. The adjustable shelf unit of claim 1, further comprising a plurality of flanges at said mounting end for attachment of said support frame to a vertical surface having a plurality of spaced holes therein.

3. The adjustable shelf unit of claim 1, wherein each of said track guide members comprises a forward edge, said forward edge adapted to abut the front end of a respective track when said tray frame is pulled toward said free end of said support unit to restrict further forward movement of said tray frame relative to said support unit.

4. The adjustable shelf unit of claim 1, wherein said track guide members comprise detent tabs that are formed from said tray frame undersurface and depend downward therefrom at an angle thereto, each of said detent tabs having an attachment end and a free end.

5. The adjustable shelf unit of claim 4, wherein the free end of each detent tab is adapted to abut the front end of a respective track when said tray frame is pulled toward said free end of said support unit to restrict further forward movement of said tray frame relative to said support unit.

6. The adjustable shelf unit of claim 4, wherein said elongated tracks are formed entirely through the thickness of said support arms.

7. The adjustable shelf unit of claim 6, wherein each of said detent tabs depends downward from said tray frame undersurface at an acute angle thereto such that a gap is formed between said free end of said detent tab and said underside of said tray frame, said gap being smaller than the thickness of said support arms, whereby, when said tray frame is moved toward said free end of said support unit, said front end of said track does not enter said gap and prevent further movement of said tray frame relative to said support unit.

8. The adjustable shelf unit of claim 6, wherein each of said detent tabs depends downward from said tray frame undersurface at an acute angle thereto such that a gap is formed between said free end of said detent tab and said underside of said tray frame, each of said detent tabs further comprising a gap filling means on an upper surface of said detent tab.

9. The adjustable shelf unit of claim 8, wherein said gap filling means comprises at least one upstanding rib on an upper surface of said detent tab, whereby, when said tray frame is moved toward said free end of said support unit, said at least one upstanding rib blocks said front end of said track from entering said gap and prevents further movement of said tray frame relative to said support unit.

10. The adjustable shelf unit of claim 9, wherein said at least one upstanding rib extends no higher than said undersurface of said tray frame.

11. The adjustable shelf unit of claim 4, wherein said tray frame is mounted onto said support unit by positioning said tray frame at said free end of said support unit and moving said tray frame towards said mounting end of said support unit, whereby contact of said detent tabs with said top surface of said support arms causes said detent tabs to detent upward until contact of said detent tabs with said front ends of said elongated tracks allows said detent tabs to spring downward into said tracks, such that each of said detent tabs is set within a respective one of said elongated tracks and moves longitudinally within said track as said tray frame moves longitudinally relative to said support unit.

12. The adjustable shelf unit of claim 11, wherein said grip elements grip said inside edges of said support arms as said tray frame moves longitudinally relative to said support unit.

13. The adjustable shelf unit of claim 4, wherein said angle is preferably 45° or less and, when said tray frame is mounted on said support unit, faces the direction of said front end of said track.

14. The adjustable shelf unit of claim 1, wherein each of said grip elements has a first portion extending downward from said tray frame undersurface and a second portion extending outward away from said inside edges of said support arms, said grip elements being situated between said track guide members and said inside edges of said support arms, whereby, when said tray frame is mounted onto said support unit, each of said first portions of said grip elements abuts a respective one of said inside edges of said support arms to restrict lateral movement of said tray frame relative to said support unit, and each of said second portions of said grip elements abuts the underside of a respective one of said support arms to restrict vertical movement of said tray frame relative to said support unit.

15. The adjustable shelf unit of claim 1 wherein said grip elements are formed from said tray frame undersurface and depend downward therefrom at an acute angle.

16. The adjustable shelf unit of claim 1 further comprising a removable tray shaped and sized to fit within said tray frame.

17. The adjustable shelf unit of claim 16, wherein said removable tray has at least one pusher plate to urge product situated within said removable tray to an edge thereof.

* * * * *